US005328530A

United States Patent [19]

Semiatin et al.

[11] Patent Number: 5,328,530

[45] Date of Patent: Jul. 12, 1994

[54] HOT FORGING OF COARSE GRAIN ALLOYS

[75] Inventors: Sheldon L. Semiatin, Dayton, Ohio; Paul A. McQuay, Tokyo, Japan

[73] Assignee: The United States of America as represented by the Secretary of the Air Force, D.C.

[21] Appl. No.: 74,099

[22] Filed: Jun. 7, 1993

[51] Int. Cl.[5] ..... C22F 1/00; C22C 14/00

[52] U.S. Cl. ..... 148/559; 148/564; 148/670; 148/671; 420/902

[58] Field of Search ..... 148/559, 564, 670, 671; 420/902

[56] References Cited

U.S. PATENT DOCUMENTS

| | | | |
|---|---|---|---|
| 4,579,602 | 4/1986 | Paulonis et al. | 148/677 |
| 4,617,817 | 10/1986 | Gegel et al. | 72/364 |
| 4,737,206 | 4/1988 | Iwai | 148/438 |
| 4,821,554 | 4/1989 | Morgan et al. | 72/377 |
| 4,867,807 | 9/1989 | Torisaka et al. | 420/902 |
| 4,935,069 | 6/1990 | Kuboki et al. | 420/902 |
| 5,026,520 | 6/1991 | Bhowal et al. | 148/670 |
| 5,055,257 | 10/1991 | Chakrabarti et al. | 420/902 |
| 5,215,600 | 6/1993 | Bertolini et al. | 148/670 |
| 5,217,548 | 6/1993 | Kuboki et al. | 148/669 |
| 5,232,661 | 8/1993 | Matsuo et al. | 148/671 |

OTHER PUBLICATIONS

Hashimoto et al. in Microstructure/Property . . . TiAl and Alloys, eds. Kim et al., AIME, 1991, pp. 253-262.

MasahashiMahahi et al, MAT. Res. Soc. Symp. Proc. #213, 1991, pp. 795-800.

Fukutomi et al. Z. Metallkde, 81 (1990) 272.

Weiss et al. Met. Trans. 17A (1986) 1935.

*Primary Examiner*—Upendra Roy

*Attorney, Agent, or Firm*—Bobby D. Scearce; Thomas L. Kundert

[57] ABSTRACT

A method for hot forging coarse grain materials to enhance hot workability and to refine microstructure is described which comprises the steps of imposing minimum initial deformation at low strain rate to effect initial dynamic recrystallization and grain refinement without fracture, and thereafter increasing the deformation rate to recrystallize the material and further refine grain structure. Depending on the deformation required to achieve full recrystallization at a given rate, deformation rate can be increased a number of times to further refine grain structure.

2 Claims, 2 Drawing Sheets

HOT FORGING OF COARSE GRAIN ALLOYS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to methods for hot forming metals and alloys, and more particularly to a method for controlling the forging process for coarse grain materials to simultaneously enhance forgeability and refine microstructure.

Hot working behavior of many high melting temperature alloys is sensitive to starting microstructure and deformation rate. In as-cast ingot metallurgy metallic and intermetallic alloys, particularly single phase alloys, coarse grain microstructures are common. Coarse structures are also common in materials previously heat treated or worked at temperatures near (>90% of) the melting point. When such coarse grain structures are hot worked, as in isothermal or conventional forging, fracture may result if the deformation rate is too high, particularly if secondary tensile stresses result such as from geometric, friction or other causes. The materials are therefore usually forged at relatively low true effective strain rates (~0.001 in/in/sec) in hydraulic presses. At these rates, dynamic restorative processes such as recovery and recrystallization occur at sufficient rates to prevent generation or growth of microscopic defects such as intergranular cracks. In many high melting temperature alloys such as those based on nickel or titanium and intermetallic materials such as the aluminides, silicides and beryllides, dynamic recrystallization predominates during hot working and usually results in refinement of grain size relative to that of the starting materials. The degree of refinement increases as deformation rate is increased and/or temperature of deformation is decreased.

The invention provides a method of controlling deformation rate during hot forging to recrystallize coarse grain structures several times during deformation while simultaneously avoiding fracture. The method comprises initial minimum deformation at a suitably low rate in order to effect an initial increment of dynamic recrystallization and grain refinement without fracture, and then further deformation(s) at increased rate(s) to re-recrystallize and further refine the grain structure.

The invention may be used for hot forging a wide range of ingot metallurgy alloys used in aircraft structures, engines, automotive components and the like. Forging response in coarse grain materials having narrow working regimes can be enhanced to improve product yield while reducing overall forging time and final product cost. The process may be used for both primary fabrication and finish forging of components, particularly in production operations based on isothermal forging.

It is therefore a principal object of the invention to provide an improved hot forging method.

It is a further object of the invention to provide a method for hot forging coarse grain alloys.

It is yet another object of the invention to provide a method for controlling the forging process for coarse grain materials to simultaneously enhance forgeability and refine microstructure.

These and other objects of the invention will become apparent as a detailed description of representative embodiments proceeds.

SUMMARY OF THE INVENTION

In accordance with the foregoing principles and objects of the invention, a method for hot forging coarse grain materials to enhance hot workability and to refine microstructure is described which comprises the steps of imposing minimum initial deformation at low strain rate to effect initial dynamic recrystallization and grain refinement without fracture, and thereafter increasing the deformation rate to recrystallize the material and further refine grain structure. Depending on the deformation required to achieve full recrystallization at a given rate, deformation rate can be increased a number of times to further refine grain structure.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
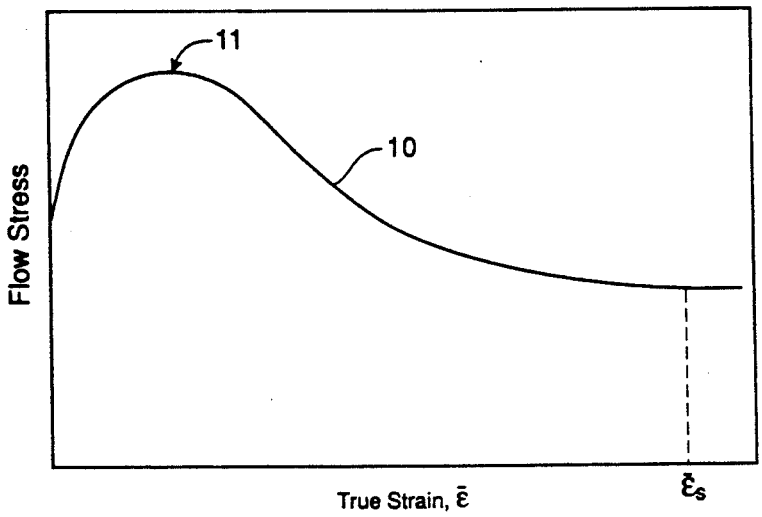
FIG. 1 is a graph of flow stress versus true strain showing qualitatively the flow curve for a material which dynamically recrystallizes during hot working.

Referring now to the drawings, FIG. 1 shows qualitatively flow curve 10 defined on a graph of flow stress versus true strain $\bar{\epsilon}$ for a material which dynamically recrystallizes during hot working. The deformation resistance (flow stress) initially increases with deformation, passes through a maximum 11 at $\bar{\epsilon}_p$, and then exhibits flow softening or decreasing flow stress at high $\bar{\epsilon}$. At a sufficiently high strain $\bar{\epsilon}_s$, substantially constant (steady state) flow is reached. Typical values of $\bar{\epsilon}_p$ and $\bar{\epsilon}_s$ for high melting temperature alloys used in aerospace applications are respectively about 0.15 and 0.75. Microstructure changes which accompany an observed flow stress response consist essentially of initiation of dynamic recrystallization at $\bar{\epsilon} \approx 5/6\bar{\epsilon}_p$; partial recrystallization of the material at strains between 5/6 $\bar{\epsilon}_p$ and $\bar{\epsilon}_s$, the volume percent of recrystallized material in the microstructure increasing in a sigmoidal fashion with strain; and full recrystallization to an equilibrium or steady state grain size at $\bar{\epsilon}$ greater than $\bar{\epsilon}_s$.

Figure 2:
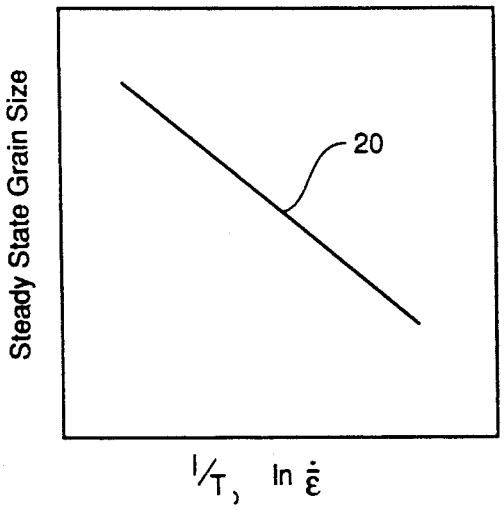
FIG. 2 shows qualitatively the relationship of steady state grain size as a function of deformation rate and temperature.
Figure 3:
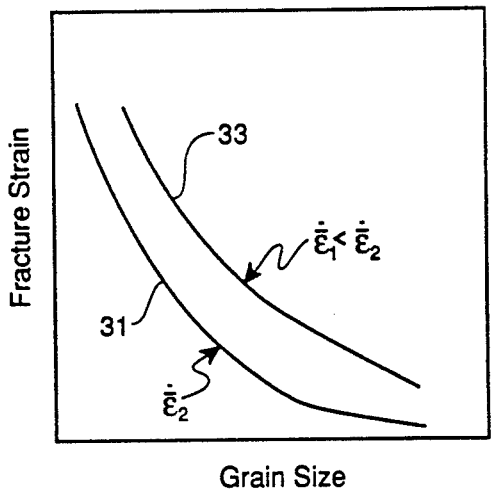
FIG. 3 is a graph of fracture strain versus grain size showing qualitatively hot workability as a function of deformation rate and grain size.

FIG. 2 shows qualitatively a plot 20 of steady state grain size as a function of deformation rate and temperature. Deformation temperature is normally in the range of about 60 to 95% of melting temperature in °K. for materials of interest herein. The logarithm of the steady state grain size which is achieved during dynamic recrystallization is typically a linear function of the logarithm of deformation rate $\dot{\bar{\epsilon}}$ and of the inverse of deformation temperature. Thus grain size in an initially coarse structured alloy can be refined by suitable choice of $\dot{\bar{\epsilon}}$ and T. Selection of suitable $\dot{\bar{\epsilon}}$ is limited, however, by the hot workability or fracture resistance of the material. FIG. 3 shows graphs 31,33 of fracture strain versus grain size showing qualitatively hot workability as a function of grain size at two different deformation rates $\dot{\bar{\epsilon}}_1$ and $\dot{\bar{\epsilon}}_2$. In general, hot workability at a given temperature increases as deformation rate decreases and as grain size decreases. In accordance with a governing principle of the invention, materials for which the invention is most applicable, that is, those in which dynamic recrystallization predominates during hot working, may include many high melting temperature alloys such as those based on nickel or titanium and intermetallic materials such as the aluminides, silicides and beryllides. Alloys of specific interest include, but are not necessarily limited to, nickel base superalloys including Waspaloy, Astroloy, Udimet 700, IN-100, and Rene 95; nickel-iron-base superalloys including alloys 718 and 901; iron-base superalloys including A-286; conventional titanium alloys including Ti-5Al-2.5Sn, Ti-8Al-1Mo-1V, Ti-6Al-4V, Ti-6Al-2Sn-4Zr-2Mo, Ti-6Al-2Sn-4Zr-6Mo, Ti-6Al-6V-2Sn, Ti-17, Ti-10V-2Fe-3Al, Ti-15V-3Cr-3Al-3Sn, Beta 21S, Ti-1100; alpha-two base titanium aluminides including Ti-24Al-11Nb, Ti-25Al-17Nb, Ti-25Al-10Nb-3V-1Mo (atomic percent); gamma-base titanium aluminides including Ti-48Al-2Cr-2Nb, Ti-46Al-5Nb-1W, Ti-51Al-2Mn (atomic percent); other near-gamma and gamma titanium aluminides of compositions (in atomic percent) in the range Ti-(40-55)Al-(0-15)M where M denotes the elements Cr, Nb, W, Mn, Ta, Mo, V, B, Si, Zr, taken singly or alloyed several at a time with titanium and aluminum; orthorhombic titanium aluminides including Ti-22Al-23Nb, Ti-22Al-27Nb (atomic percent); nickel aluminides based on $Ni_3Al$ or NiAl; iron aluminides based on $Fe_3Al$ or FeAl; $Nb_3Al$ and $NbAl_3$; niobium silicides such as those based on Nb-$Nb_5Si_3$; silicides based on $MoSi_2$; and beryllides such as $Be_{12}Nb$, $Be_{17}Nb_2$, $Be_{19}Nb_2$, $Be_{12}Ti$, $Be_{12}Ta$, and $Be_{13}Zr$.

Figure 4:
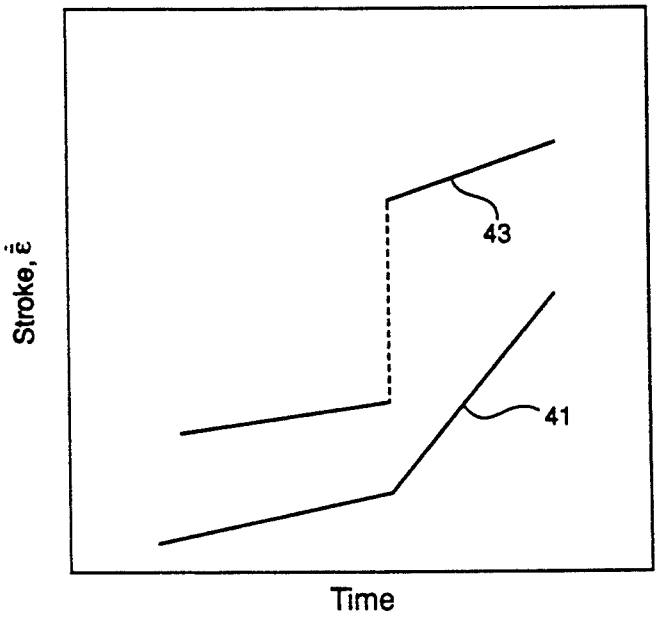
FIG. 4 is a graph of stroke (strain rate) versus time representative of the method of the invention.

FIG. 4 shows graphs 41,43, respectively, of ram stroke versus time and strain rate versus time for an isothermal forging process representative of the method of the invention performed on an initially coarse grain material. Deformation (forging) temperature is about 60 to 95% of melting, and preferably about 90% of melting and, for the high melting temperature alloys of most interest here is in a range of about 1200° to 1800° K. During the initial deformation step ram velocity and strain rate are held relatively low (about 0.5 to $5\times10^{-3}$ in/in/sec) to avoid fracture, because the coarse grain material has limited workability, and to bring about a substantially fully recrystallized finer grain structure with better workability. This usually requires a deformation $\bar{\epsilon}$ of approximately 0.75 (equivalent to a reduction in height ratio of about 2:1). Thereafter, ram velocity (strain rate) is typically increased by a factor of about 20 to 100 and an additional strain of about 0.75 is imposed to further refine the grain size. Total strains in the forging process may exceed 2.0. Therefore, a plurality of deformation rate increments may be used in the practice of the invention to successively re-recrystallize and refine the microstructure during a given processing operation.

During isothermal forging of materials of most interest, $\dot{\bar{\epsilon}}_1$ would typically lie in the range of 0.5 to $10\times10^{-3}$ in/in/sec, whereas $\dot{\bar{\epsilon}}_2$ would usually be a factor of 20 to 100 times larger i.e., 0.01 to 1.0 in/in/sec. In the preferred embodiment, $\dot{\bar{\epsilon}}_1$ is 1 to $3\times10^{-3}$ in/in/sec and $\dot{\bar{\epsilon}}_2$ is 0.025 to 0.1 in/in/sec. The precise ranges of strain rates are limited by the press characteristics, die material strength, and the exigencies of economic production.

Figure 5:
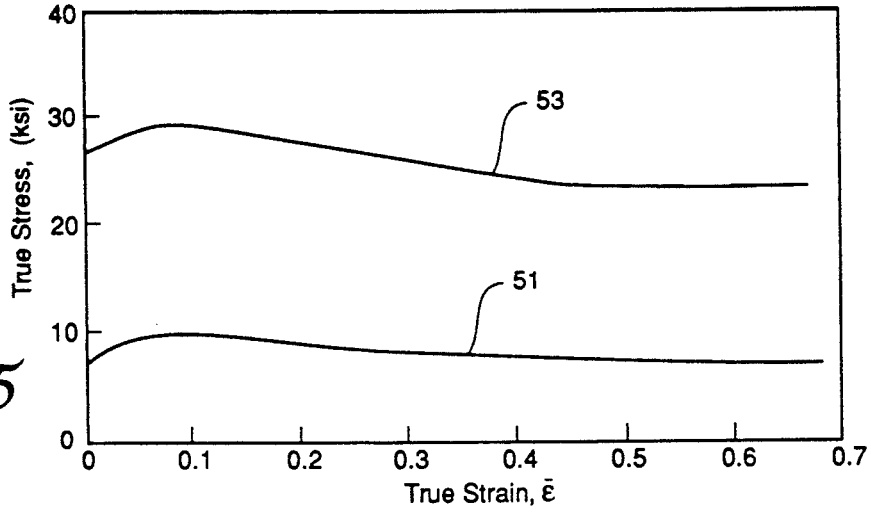
FIG. 5 is a graph of true stress versus true strain for Ti-51Al-2Mn alloy at 2100° F. at two different strain rates.
Figure 6:
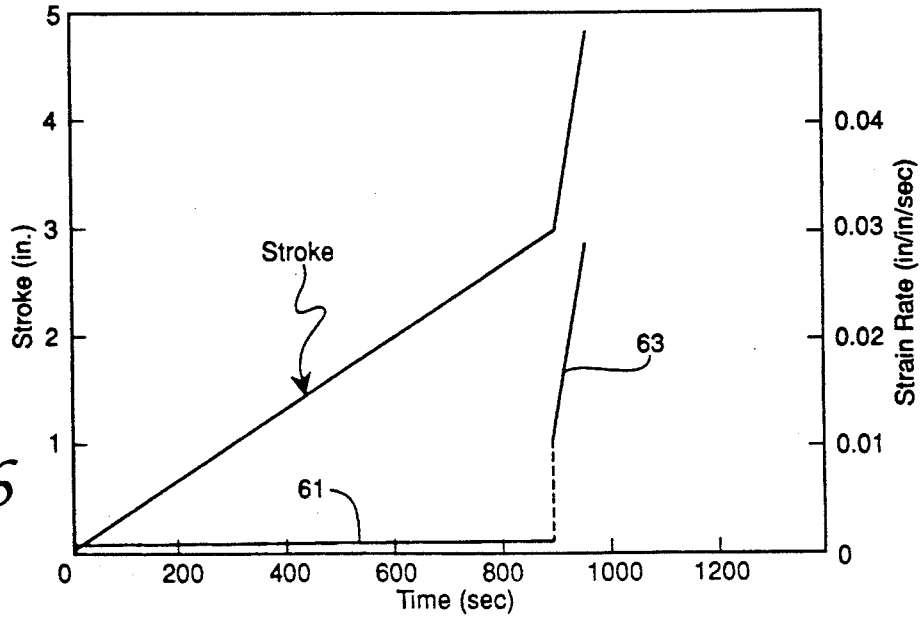
FIG. 6 is a graph of stroke versus time for a forging done in demonstration of the invention.

The demonstration material selected for forging was a gamma titanium aluminide (Ti-51Al-2Mn) billet. The starting ingot had a grain size of about 400 microns ($\mu$) and was converted to wrought product with grain size of about 25$\mu$ in a single forging stroke. FIG. 5 shows specific stress-strain data for this alloy deformed at 2100° F. at strain rates of 0.001 in/in/sec (curve 51) and 0.1 in/in/sec (curve 53). Both stressestrain curves have a maximum at $\bar{\epsilon}$ of about 0.1 followed by softening until a steady state stress is obtained at $\bar{\epsilon}$ of about 0.6; this behavior is indicative of a material undergoing dynamic recrystallization, as discussed above. Table I summarizes the results of several forging trials for the Ti-5Al-2Mn alloy. Referring now to FIG. 6 for forging number 1, an initial strain rate (graph 61) of 0.0006 in/in/see was imposed; after a reduction of 2:1 ($\bar{\epsilon}$=0.69), the crosshead speed was increased to yield a second strain rate (graph 63) of 0.029 in/in/sec at the conclusion of deformation with a final overall reduction of 4:1. This process yielded a fine (25$\mu$ grain size) uniform structure with no defects. For forging number 2, strain rate was increased from 0.001 to 0.52 in/in/sec with similar success and refined grain size. By contrast, for forging number 3, initial and final deformation rates were high (0.5 in/in/sec) which led to substantial macroscopic and microscopic cracking.

Although the invention was demonstrated using isothermal pancake forging, open or closed die forging, hot die forging or other conventional forging processes may be used as would occur to the skilled artisan guided by these teachings. The invention is best practiced using computer controlled equipment (e.g., hydraulic forging press) into which precise ram stroke versus time profiles can be programmed based on data from simulative workability tests such as hot upset or hot tension tests. The invention is most applicable to manufacture of discrete components, but can be applied to processes such as ring rolling. The product may be a semifinished (i.e. for subsequent processing) or finished part.

TABLE I

| Forging Number | $\dot{\bar{\epsilon}}_1$ (in/in/sec) | $\dot{\bar{\epsilon}}_2$ (in/in/sec) | Observations |
|---|---|---|---|
| 1 | 0.0006 | 0.029 | Good forging-no defects |
| 2 | 0.01 | 0.52 | Good forging-no defects |
| 3 | 0.52 | — | Bad forging-multiple defects |

The invention therefore provides a method for optimizing hot workability of coarse grain materials, particularly difficult-to-work high melting temperature alloys, in obtaining refined microstructures in the materials. It is understood that modifications to the invention may be made by one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for forging a coarse grain material to enhance hot workability and to refine microstructure of said material, comprising the steps of:

(a) providing a billet of coarse grain material;

(b) heating said billet to a temperature of at least 60 percent of the melting temperature of said material in °K.;

(c) deforming said billet at a first strain rate in the range of about $1\times10^{-3}$ to $3\times10^{-3}$ in/in/sec and to effect a first increment of dynamic recrystallization and grain refinement without fracture in said material; and (d) thereafter deforming said billet at a second strain rate in the range of about 0.025 to 0.1 in/in/sec to effect a further degree of dynamic recrystallization and grain refinement without fracture in said material.

2. The method of claim 1 wherein said deformation step is performed using hot isothermal forging.

* * * * *